US008915613B2

(12) United States Patent
Clark et al.

(10) Patent No.: US 8,915,613 B2
(45) Date of Patent: Dec. 23, 2014

(54) LIGHT EMITTING DIODE LUMINAIRE DEVICE AND SYSTEM

(75) Inventors: Walter Blue Clark, Palo Alto, CA (US); Johannes Dale Toale, San Jose, CA (US)

(73) Assignee: FineLite Inc., Union City, CA (US)

( * ) Notice: Subject to any disclaimer, the term of this patent is extended or adjusted under 35 U.S.C. 154(b) by 201 days.

(21) Appl. No.: 13/507,542

(22) Filed: Jul. 9, 2012

(65) Prior Publication Data

US 2013/0329424 A1 Dec. 12, 2013

Related U.S. Application Data

(60) Provisional application No. 61/689,410, filed on Jun. 6, 2012.

(51) Int. Cl.
*F21S 4/00* (2006.01)

(52) U.S. Cl.
USPC ..... 362/249.02; 362/249.01; 362/311.01

(58) Field of Classification Search
CPC ..... F21Y 2101/02
USPC ..... 362/249.02, 249.01, 311.01
See application file for complete search history.

(56) References Cited

U.S. PATENT DOCUMENTS

2005/0047167 A1* 3/2005 Pederson et al. ..... 362/542
2011/0211351 A1* 9/2011 Van De Ven et al. .... 362/249.02

* cited by examiner

*Primary Examiner* — Vip Patel
(74) *Attorney, Agent, or Firm* — James A. Gavney, Jr.; JAG Patent Services

(57) ABSTRACT

A lighting device is disclosed that includes one or more master circuit boards configured to power light emitting diodes. The lighting device also includes modular light boards with arrays of light emitting diodes that interchangeably couple to the matched connectors on the master circuit board. The master circuit boards and the modular light boards are positioned within a housing with one or more diffuser lenses. In accordance with the embodiments of the invention, master circuit boards and modular light boards are mounted in a stacked arrangement to emit light from opposed sides of the housing. In further embodiments of the invention, the lighting device includes a controller for independently controlling light output from each master circuit board.

18 Claims, 3 Drawing Sheets

LIGHT EMITTING DIODE LUMINAIRE DEVICE AND SYSTEM

RELATED APPLICATION

This application claims priority under 35 U.S.C. §119(e) from the U.S. provisional patent application Ser. No. 61/689,410, filed on Jun. 6, 2012, and titled "LUMINAIRE DEVICE AND SYSTEM." The provisional patent application Ser. No. 61/689,410, filed on Jun. 6, 2012, and titled "LUMINAIRE DEVICE AND SYSTEM" is hereby incorporated by reference.

FIELD OF THE INVENTION

This invention relates to lighting systems. More specifically, this invention relates to Light Emitting Diode (LED) devices and systems.

BACKGROUND OF THE INVENTION

A light-emitting diode (LED) is a semiconductor diode that emits light when an electrical current is applied in the forward direction of the device, such as in a simple LED circuit.

The device is fabricated from layers of silicon and seeded with atoms of phosphorus, germanium, arsenic or other rare-earth elements. The layers of the device are called the die and the junction between the materials is where the light is generated. The electricity enters from one side of the die and exits out the other. As the current passes through the LED device, the materials that makes up the junction react and light is emitted. LEDs are widely used as indicator lights on electronic devices and increasingly in higher power applications such as flashlights and area lighting. A LED is usually a small area (less than 1 $mm^2$) light source, often with optics added to the chip to shape its radiation pattern and assist in reflection. The color of the emitted light depends on the composition and condition of the semiconducting material used, and can be infrared, visible, or ultraviolet.

SUMMARY OF THE INVENTION

The present invention is directed to a lighting device. The lighting device includes a first master circuit board with connectors configured to power light emitting diodes. The first master circuit board is coupled to a transformer for converting alternating current to direct current for powering the light emitting diodes. The lighting device further includes a first set of modular light boards with arrays of light emitting diodes. Preferably, the light emitting diodes used in the lighting device of the present invention each use 0.2 watts or less of electrical power. Also, preferably each of the modular light boards within the first set of modular light boards include an array of 20 or more light emitting diodes and upwards of 40 or more light emitting diodes.

The first set of modular light boards have matched connectors that detachably and interchangeably couple to the connectors on the first master circuit board. Accordingly, modular light boards are capable of being changed in the event that any one of the modular light boards fails or diodes on any one of the modular light boards fail. Also, modular light boards of the present invention can be added or removed according to the lighting needs of the environment where the lighting device is installed.

The lighting device also includes a housing for holding the first master circuit board and the first set of modular light boards. Preferably, the housing is an elongated housing with a first diffuser lens. The first master circuit board is positioned within the elongated housing, such that light emitted from the arrays of light emitting diodes on the first set of modular light boards is emitted through the first diffuser lens.

In further embodiment of the invention, the lighting device further comprising aza second master circuit board with connectors configured to power light emitting diodes. The second master circuit board is configured to power and electrically couple to a second set of modular light boards having arrays of light emitting diodes, such as decided above with reference to the first master circuit board. In accordance with this embodiment of the invention the lighting device also includes a second diffuser lens coupled to the elongated housing and positioned on an opposed side of the elongated housing relative to the first diffuser lens. In operation, the second master circuit board is configured to emit light from the arrays of light emitting diodes on the second set of modular light boards through the second diffuser lens.

In yet further embodiments of the invention, the lighting device includes a controller for independently controlling light output from the first set of modular light boards and the second set of modular light boards. Alternatively, or in addition to the control feature described above, the lighting device is configured with a controller for selectively controlling light output from any of the arrays of light emitting diodes on any one of the modular light boards of the first master circuit and the second master circuit.

The interchangeable and modular features of the modular light boards allows for the construction of unique lighting systems that are either suspended from a ceiling or wall and/or that are integrated into a ceiling or wall. In accordance with the embodiments of the invention, the lighting device includes one or more mounting features or hardware for securing the lighting device to a wall or a ceiling. For example, the lighting device includes one or more cable features for mounting to a ceiling, one or more bracket features for mounting to a wall and/or adjustable or fixed flange features for mounting the lighting device recessed within a wall.

DETAILED DESCRIPTION OF THE INVENTION

Figure 1A:
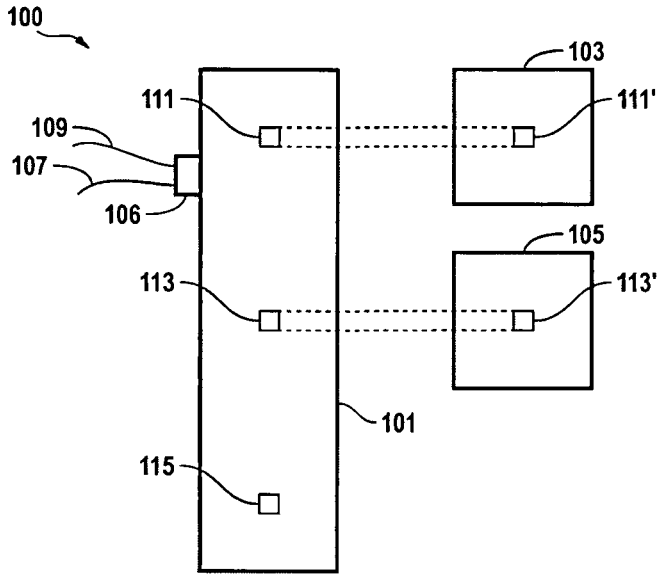
FIG. 1A is a schematic representation of a master circuit board with modular light boards having matched connectors that detachably and interchangeably couple to the connectors on the master circuit board, in accordance with the embodiments of the invention.

FIG. 1A is a schematic representation 100 of a master circuit board 101 with modular light boards 103 and 105 that have matched connectors 111' and 113' that detachably and interchangeably couple to the connectors 111, 113, 115 on the master circuit board 101. The master circuit board 101 includes, or is electrically coupled to, a transformer 106 for converting alternating current from power leads 107 and 109 into direct current for powering light emitting diodes. The master circuit board 101 along with modular light boards 103 and 105 are used in a lighting device such as described in detail below.

Figure 1B:
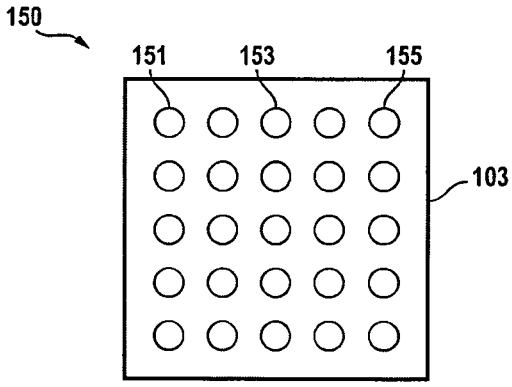
FIG. 1B shows of an array of light emitting diodes on a modular light board that electrically couples to the master circuit board, in accordance with the embodiments of the invention.

FIG. 1B shows a schematic representation 150 of an array of light emitting diodes 151, 153 and 155 on a modular light board 103 that electrically couples to a master circuit board 101 (FIG. 1A). Each of the modular light boards 103 and 105 in the lighting device of the present invention include arrays of light emitting diodes with 20 or more discrete light emitting diodes and upwards of 40 or more discrete light emitting diodes. Preferably, the discrete light emitting diodes used in the lighting device of the present invention each use 0.2 watts or less of electrical power.

The modular light boards 103 and 105 of the lighting device are capable of being individually changed in the event that any one of the modular light boards 103 and 105 fails or diodes on any one of the modular light boards 103 and 105 fails. A lighting device or lighting system of the present invention includes any number of modular light boards and modular light boards can be added or removed according to lighting needs of the environment where the lighting device is installed.

Figure 2A:
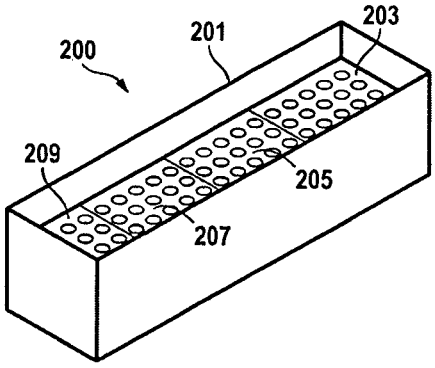
FIG. 2A shows a perspective view of a lighting device with an elongated housing, in accordance with the embodiments of the invention.

FIG. 2A shows a perspective view of a lighting device 200 with an elongated housing 201, in accordance with the embodiments of the invention. The elongated housing 201 is configured for holding one or more master circuit boards each with any number of modular light boards 203, 205, 207 and 209 with each of the modular light boards having arrays of light emitting diodes, such as described above. Preferably, the elongated housing 210 has a diffuser lens (not shown) that is positioned in front of the arrays of light emitting diode for diffusing light emitted therefrom.

Figure 2B:
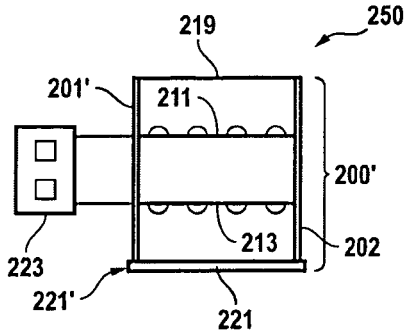
FIG. 2B shows a cross-sectional view of a lighting device with staked arrays of light emitting diodes for emitting light through opposed sides of a housing structure, in accordance with the embodiments of the invention.

FIG. 2B shows a cross-sectional view 250 of a lighting device 200' with stacked arrays of light emitting diodes 211 and 213 for emitting light through opposed sides of a housing structure 201'. The stacked arrays of light emitting diodes 211 and 213 are positioned on any number of modular light boards that are eclectically coupled to a respective master circuit through matched connectors, such as described above with reference to FIG. 1A. Each of the master circuit board is electrically coupled to a transformer and any other necessary circuitry for powering the stacked arrays of light emitting diodes 211 and 213 from an alternating current power source (not shown).

Still referring to FIG. 2B, in accordance with the embodiments of the invention the lighting device 200' includes a controller 223. The controller 223 allows for independently controlling light output from each master circuit board, from each modular light boards and/or from each of the stacked arrays of light emitting diodes 211 and 213. Preferably, the lighting device 200' includes diffuser lenses 219, and 221 positioned in front of each of the stacked array of light emitting diodes 211 and 213, respectively. In accordance with further embodiments of the invention one of the diffuser lenses 221, or both of the diffuser lenses, extends along a wall portion 202 of the housing 201, such that soft-wash lighting emits from side surfaces 221' of the diffuser lens 221 with the array of light emitting diodes 213 powered on.

Figure 3A:
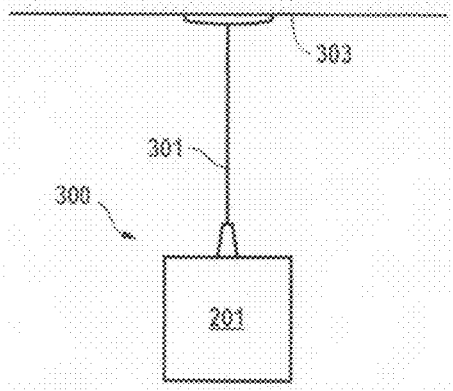
FIGS. 3A-D show mounting features for securing a lighting device to a wall or a ceiling, in accordance with the embodiments of the invention.
Figure 3B:
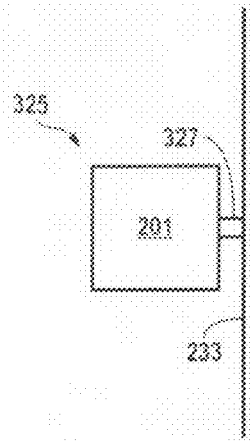
Figure 3C:
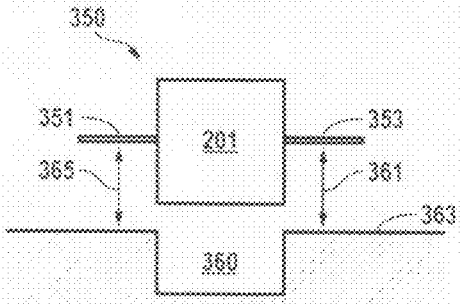
Figure 3D:
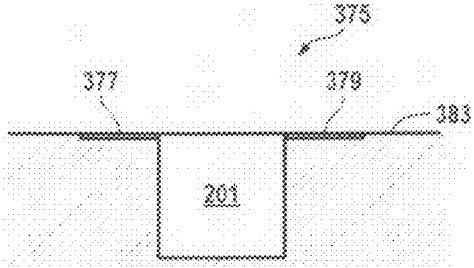

FIGS. 3A-D show several mounting features for securing a lighting device of the present invention to a wall or a ceiling, in accordance with the embodiments of the invention. FIG. 3A shows a view 300 of a lighting device 201 that is attached to a ceiling 303 through a cable feature. FIG. 3B shows a view 325 of a lighting device 201 attached to a wall 233 through a bracket feature. FIG. 3C shows a view 350 of a lighting device 201 with adjustable flanges or side brackets 351 and 353. In operation the adjustable flanges or side brackets 351 and 353 are moved up or down as indicated by the arrows 361 and 365, such that the housing portion of the lighting device 201 fits into a slot or cavitation 360 on a wall or ceiling 363. FIG. 3D shows a view 375 of a lighting device 201 that includes fixed flanges or side brackets 377 and 379 that are configured to mount the lighting device 201 flush with a wall or ceiling 383. In accordance with the embodiment of the invention the fixed flanges or side brackets 377 and 379 are configured to be nailed or screwed to wall or ceiling studs and finished with drywall, drywall mud, plaster or trim. It will be clear to one skilled in the art, that while the lighting device 201 of the present invention is mostly described and being elongated, other shapes and geometries, such as square lighting devices, triangular lighting devices and round lighting devices are contemplated. Further, the lighting device of the present invention can include any number of different types mounting features or mounting hardware.

Figure 4A:
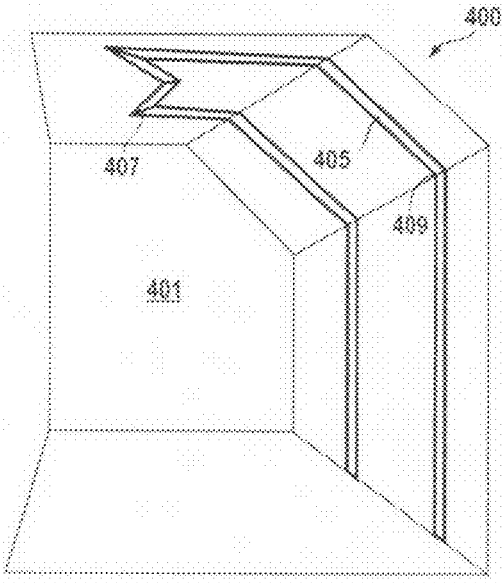
FIGS. 4A-B show lighting devices with continual and angled lighting that is recessed within a wall, in accordance with the embodiments of the invention.
Figure 4B:
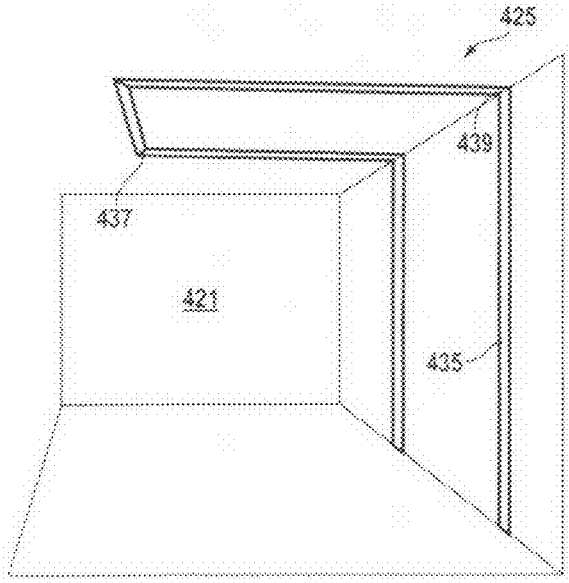

The interchangeable and modular features of the lighting device of the present invention allows for the construction of unique lighting devices that are integrated into a ceiling or wall using the mounting or bracket features described with reference to FIGS. 3C-D. For example FIG. 4A shows a view 400 of a lighting device 405 that is integrated into a ceiling and a wall of a room 401. Again, the lighting device is configured to provide continuous and even or uniform lighting throughout and at inflection portions 409 and angled portions 407 along the lighting device 405. FIG. 4B shows a view 425 of an alternative lighting device 435 that is integrated into a ceiling and a wall of a room 421 and that provides continuous and even or uniform lighting through out and at angled portions 437 and 439 along the lighting device 435.

Figure 5A:
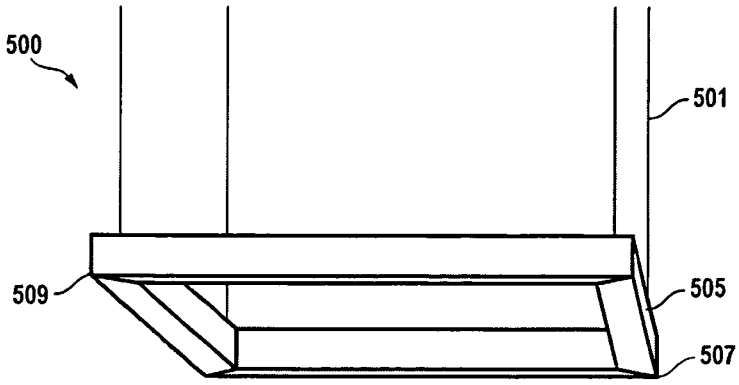
FIG. 5A shows a view of a rectangular lighting device that is suspended from a ceiling through a number of cable features, in accordance with the embodiments of the invention.
Figure 5B:
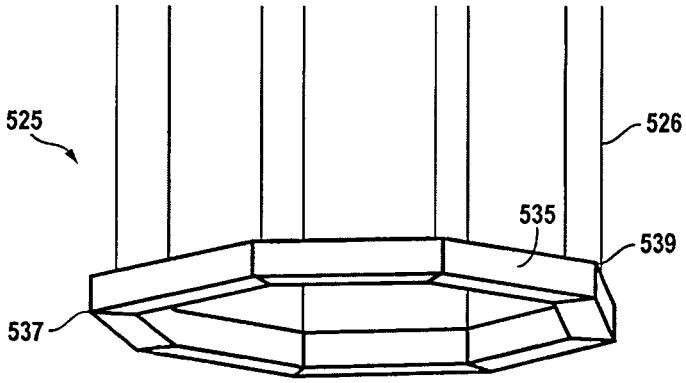
FIG. 5B shows a view of an octagonally shaped lighting device that is suspended from a ceiling through an number of cable features, in accordance with the embodiments of the invention.

The interchangeable and modular features of the lighting device of the present invention also allows for the construction of unique lighting devices that are either suspended from a ceiling or wall using the mounting features, such as described with reference to FIGS. 3A-B. For example, FIG. 5A shows a view 500 of a rectangular lighting device 505 that is suspended from a ceiling through a number of cable features 501. The corners 507 and 509 provide continuous and even or uniform lighting. FIG. 5B shows a view 525 of an octagonally shaped lighting device 535 that is suspended from a ceiling through an number of cable features 526. Again, the angled portions 537 and 539 of the lighting device provide continuous and even or uniform lighting.

Figure 6:
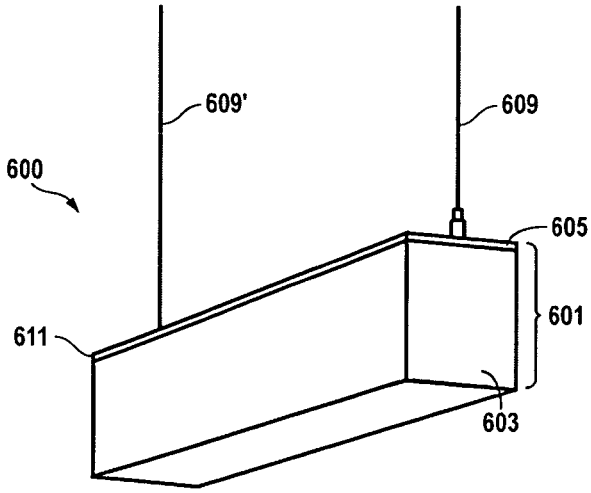
FIG. 6 shows a schematic representation of an elongated lighting device with soft-wash side lighting features, in accordance with the embodiments of the invention.

FIG. 6 shows a view 600 of a lighting device 601 with an elongated housing for housing stacked arrays of light emitting diodes 211 and 213 (FIG. 2B) that emit light through opposed sides of the elongated housing. In this example, the lighting device 601 is suspended from a ceiling through cable features 609 and 609'. However, as mentioned, any number of mounting features and/or mounting hardware are contemplated to be used for installing the lighting device 601. Preferably, the lighting device 600 includes a controller, such as described with reference to FIG. 2B, for independently controlling light output from each of the stacked arrays of light emitting diodes positioned within the elongated housing of the lighting device 601. The lighting device 601 also preferably includes diffuser lenses, such as described with reference to FIG. 2B, positioned in front of each of the stacked arrays of light emitting diodes, wherein one of the diffuser lenses extends along a wall portion of the elongated housing of the lighting device 601 to provide soft-wash lighting that emits from side surfaces 611 of the diffuser lens when the top array of light emitting diodes is powered on. Preferably, side portions of the lighting device 601 are formed from two portions 603 and 605, with a top portion 605 being partially translucent to provide additional soft-wash lighting and an opaque housing portion.

The present invention has been described in terms of specific embodiments incorporating details to facilitate the understanding of the principles of construction and operation of the invention. As such, references herein to specific embodiments and details thereof are not intended to limit the scope of the claims appended hereto. It will be apparent to those skilled in the art that modifications can be made in the embodiments chosen for illustration without departing from the spirit and scope of the invention.

What is claimed is:

1. A lighting device comprising:

a) a first master circuit board with connectors configured to power arrays of light emitting diodes;

b) a first set of modular light boards with the arrays of light emitting diodes and matched connector configured to detachably and interchangeably couple to the connectors on the first master circuit board; and c) an elongated housing with a first diffuser lens, the elongated housing being configured for holding the first master circuit board and emitting light from the arrays of light emitting diodes through the first diffuser lens.

2. The lighting device of claim 1, wherein the first master circuit board includes a transformer.

3. The lighting device of claim 2, wherein arrays of light emitting diodes include 20 or more light emitting diodes.

4. The lighting device of claim 1, wherein the light emitting diodes use 0.2 watts or less of electrical power.

5. The lighting device of claim 1, further comprising:

a) a second master circuit board with connectors configured to power light emitting diodes;

b) a second set of modular light boards with arrays of light emitting diodes and a matched connector configured to detachably and interchangeably couple to the connectors on the second master circuit board; and c) a second diffuser lens coupled to the elongated housing positioned on an opposed side of the elongated housing relative to the first diffuser lens, wherein the second master circuit board is configured to emit light from the arrays of light emitting diodes of the second set of modular light boards through the second diffuser lens.

6. The lighting device of claim 1, further comprising a controller for independently controlling light output from the first set of modular light boards and the second set of modular light boards.

7. A lighting device comprising:

a) an elongated housing with two stacks of light emitting diodes arrays positioned within the elongated housing and configured to emit light through opposed sides of the elongated housing; and b) a controller for independently controlling light output from the two stacks of light emitting diodes arrays, wherein each of the two stacks include a master circuit board with connectors and modular light boards with arrays of light emitting diodes having matched connectors configured to detachably and interchangeably couple to the connectors on the master circuit board.

8. The lighting device of claim 7, wherein modular light boards have 20 or more light emitting diodes.

9. The lighting device of claim 8, wherein each light emitting diode uses use 0.2 watts or less of electrical power.

10. The lighting device of claim 7, further comprising diffuser lenses positioned in front the stacks of light emitting diodes arrays.

11. The lighting device of claim 7, further comprising a mounting features for securing to a wall or a ceiling.

12. A method of making a light device comprising:

a) forming first master circuit board with connectors configured to power arrays of light emitting diodes;

b) forming a first set of modular light boards with the arrays of light emitting diodes and a matched connector configured to detachably and interchangeably couple to the connectors on the first master circuit board; and c) placing the first master circuit board and the modular light boards in an elongated housing with a first diffuser lens, such that light from the arrays of light emitting diodes pass through the first diffuser lens.

13. The method of claim 12, further placing second master circuit board with a second set of modular light boards having arrays of light emitting diodes within the elongated housing, such that light from the light emitting diodes of the second set of modular light boards is emitted through an opposed side of the elongated housing relative to the first diffuser lens.

14. The method of claim 13, further comprising connecting a controller unit to the first master circuit board and the second master circuit board, such the arrays of light emitting diodes on the first master circuit board and the second master circuit board are independently controllable.

15. The method of claim 14, further comprising placing a second diffuser lens over the opposed side of the elongated housing.

16. The method of claim 12, further comprising forming a mounting features coupled to the elongated housing for mounting the light device on a wall or a ceiling.

17. The method of claim 12, wherein the arrays of light emitting diodes on the first set of modular light boards each include 20 or more light emitting diodes.

18. The method of claim 12, wherein the 20 or more light emitting diodes use 0.2 watts or less of electrical power.

* * * * *